United States Patent [19]

Nelson

[11] Patent Number: 4,842,422

[45] Date of Patent: Jun. 27, 1989

[54] ECCENTRIC ADJUSTER FOR DRAWER OR CABINET TRACK

[76] Inventor: Gary W. Nelson, 22933 Hatteras St., Woodland Hills, Calif. 91367

[21] Appl. No.: 236,534

[22] Filed: Aug. 25, 1988

[51] Int. Cl.[4] ..... F16C 29/12

[52] U.S. Cl. ..... 384/19; 384/22; 384/57; 384/255

[58] Field of Search ..... 384/19, 22, 57, 58, 384/255, 40; 312/341 R

[56] References Cited

U.S. PATENT DOCUMENTS

| | | | |
|---|---|---|---|
| 1,970,439 | 8/1934 | Townsend . | |
| 3,095,250 | 6/1963 | Frederick . | |
| 3,099,501 | 7/1963 | Hillson et al. . | |
| 3,112,960 | 12/1963 | Hillson et al. . | |
| 3,467,450 | 9/1969 | Schmidt et al. | 384/255 |
| 3,504,952 | 4/1970 | Farmer | 384/57 |
| 3,635,103 | 1/1972 | Monti | 384/255 |
| 3,874,748 | 4/1975 | Figueroa | 384/19 |
| 4,070,076 | 1/1978 | Zwillinger . | |
| 4,236,773 | 12/1980 | Mertes . | |
| 4,580,851 | 4/1986 | Nelson . | |
| 4,615,572 | 10/1986 | Nelson . | |
| 4,645,359 | 2/1987 | Nelson . | |
| 4,732,436 | 3/1988 | Nelson . | |
| 4,747,704 | 5/1988 | Nelson . | |

*Primary Examiner*—Lenard A. Footland
*Attorney, Agent, or Firm*—William W. Haefliger

[57] ABSTRACT

Track level adjustment mechanism for adjusting the level of an elongated drawer track relative to cabinetry track support structure, comprises a track having a wall portion facing the support structure, a dog element adjacent the wall portion and a fastener attaching that element to the support structure to be loosened for allowing movement of the dog element relative to the support structure and to the track wall portion, and a shoulder on the track to be engaged by the dog element in response to dog element movement relative to the support structure, thereby to level adjust the track wall portion relative to the support structure.

13 Claims, 4 Drawing Sheets

ECCENTRIC ADJUSTER FOR DRAWER OR CABINET TRACK

BACKGROUND OF THE INVENTION

This invention relates generally to drawer level adjustment, as in cabinets; and more particularly to adjusting of tracks that support drawers that move inwardly and outwardly relative to cabinet.

Drawers are commonly mounted on rollers that roll on tracks in cabinets to facilitte ease of in and out movement. If left and right tracks that support a drawer, as on such rollers, are not closely parallel, ease of drawer movement is disrupted. In the past it was difficult and time consuming to install or adjust left and right side tracks, on cabinet walls, or on drawer walls, to be parallel. Small level adjustments of one track relative to another were a constant problem.

SUMMARY OF THE INVENTION

It is a major object of the invention to provide means for drawer track level adjustments that overcome the above problem. Basically, the invention is embodied in track level adjustment mechanism for adjusting the level of an elongated drawer track relative to cabinetry track support structure, comprising:

(a) the track having a wall portion facing the support structure, (b) a dog element adjacent that wall portion and a fastener attaching that element to the support structure to be loosened for allowing movement of the dog element relative to the support structure and to the track wall portion, (c) and shoulder means on the track to be engaged by the dog element in response to said dog element movement relative to the support structure, thereby to level adjust said track wall portion relative to the support structure.

It is another object of the invention to provide for pivotal mounting of the dog element by the fasteners, and the dog element typically extends in a through opening defined by the track wall portion. The dog element may comprise a rotor, or a gear section, or a clamp overlying the track wall portion.

It is yet another object to provide the track in the form of a channel in which said dog element is received, and including drawer supporting roller means in the channel. The track is typically supported at a locus at a distance from the dog element so that the track is tilted about said locus in response to said movement of the dog element to displace said shoulder means.

These and other objects and advantages of the invention, as well as the details of an illustrative embodiment, will be more fully understood from the following specification and drawings, in which:

DRAWING DESCRIPTION

Figure 7:
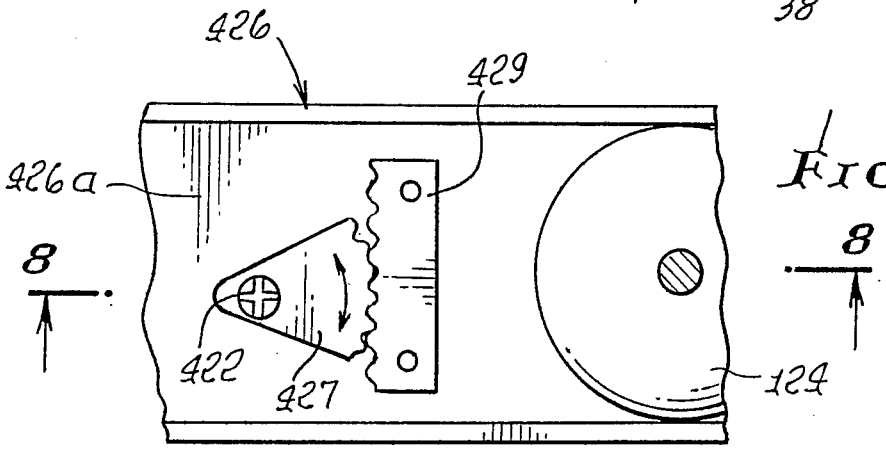
Figure 8:
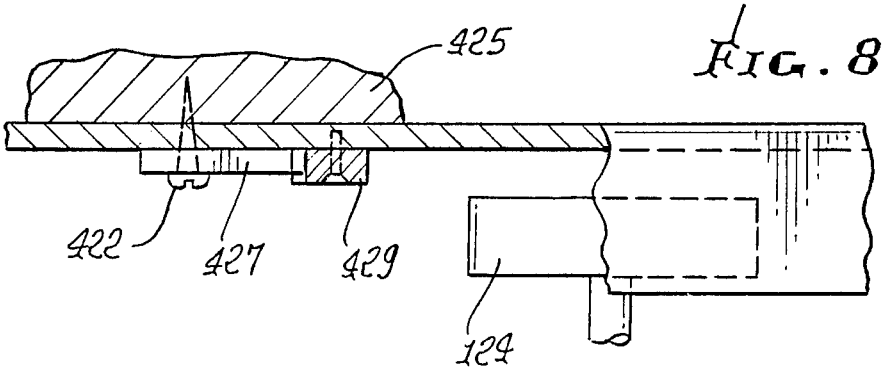
Figure 4:
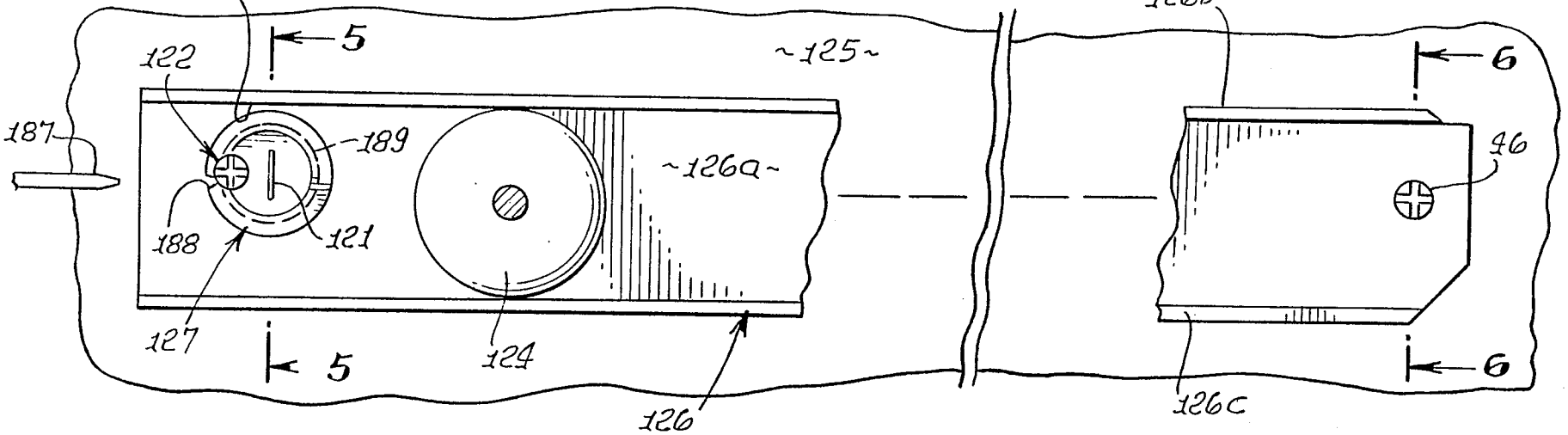
FIG. 4 is an enlarged side view of a track with means for adjusting track level or tilt.
Figure 6:
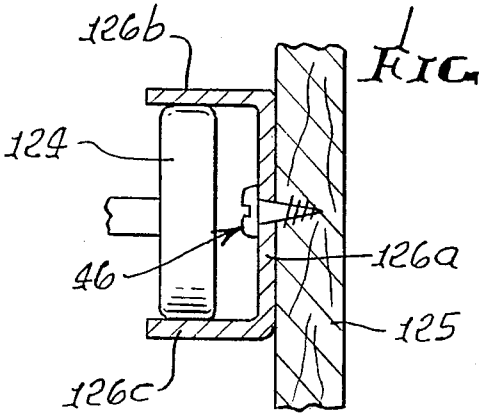
Figure 5:
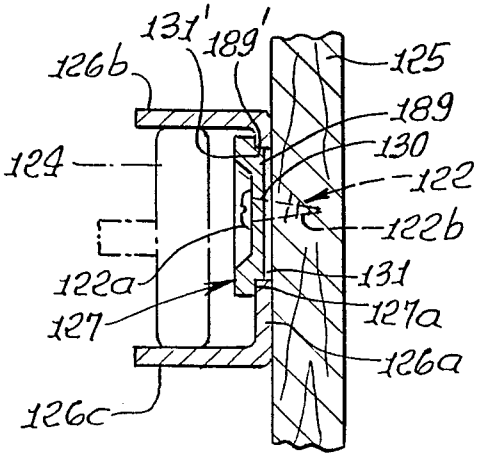
Figure 10:
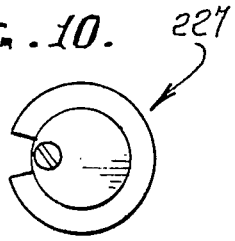
Figure 11:
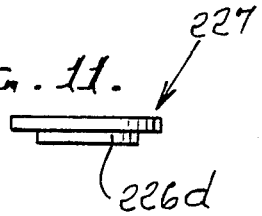
Figure 9:
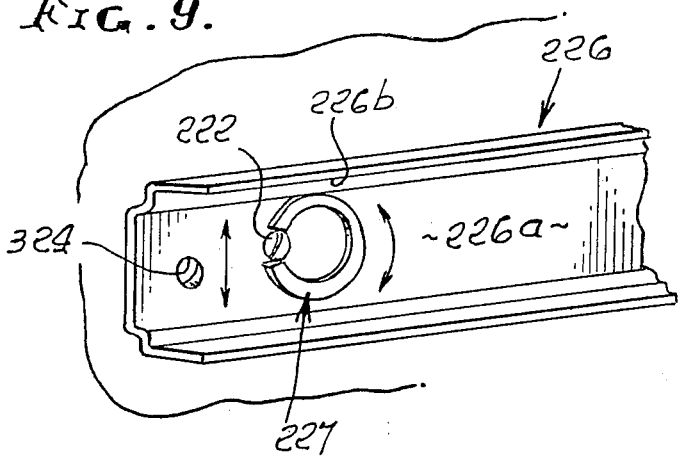
Figure 12:
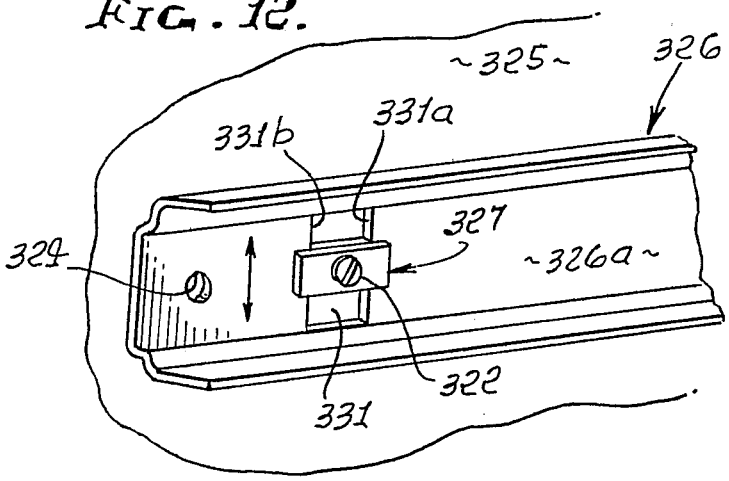
Figure 13:
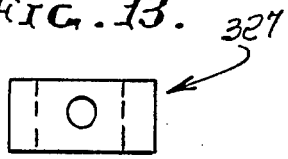
Figure 14:
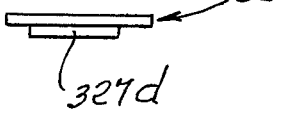
Figure 15:
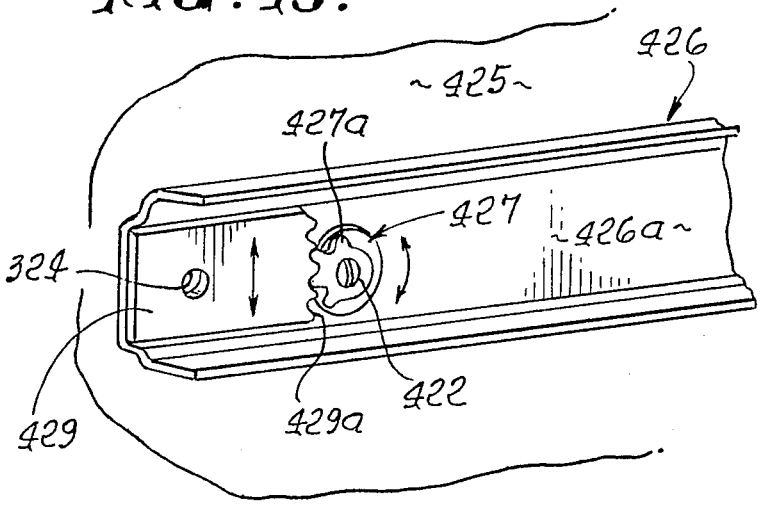
Figure 16:
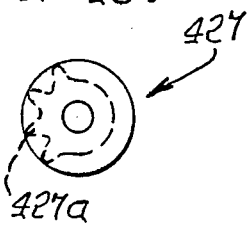
Figure 17:
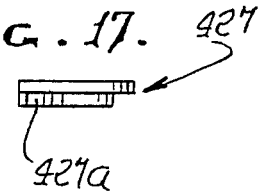

FIG. 5 and 6 are sections taken on lines 5—5, and 6—6 in FIG. 4';

FIG. 7 is a view like FIG. 4, showing another modified track level adjustment means;

FIG. 8 is a horizontal section taken on lines 8—8 of FIG. 7;

FIG. 9 is perspective view of a further modified track level adjustment means; and FIGS. 10 and 11 are front and edge views of a rotor use in FIG. 9;

FIG. 12 is a perspective view of still another modified track adjustment means; and FIGS. 13 and 14 are front and edge views of a dog element used in FIG. 12; and FIG. 15 is a perspective view of yet another track adjustment means and FIGS. 16 and 17 are front and edge views of a gear type dog mechanism seen in FIG. 15.

DETAILED DESCRIPTION

Reference will first be made to the track guided drawer and cabinet assembly as seen in FIGS. 1–4, which is merely for illustration, it being understood that the invention is usable in other such assemblies.

Figure 1:
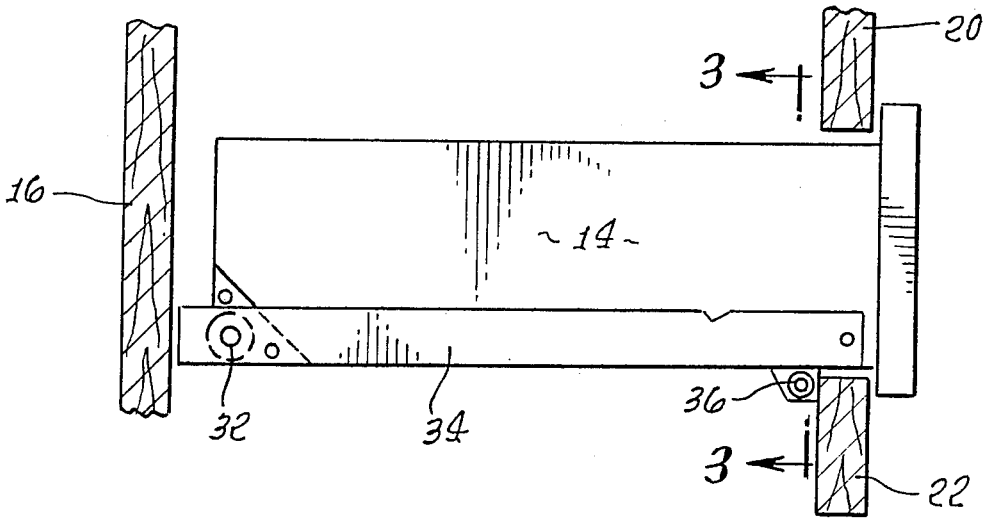
FIG. 1 is a side view of a drawer arrangement, in a cabinet.

FIG. 1 is schematic view showing a drawer 14 which is mounted in a manner illustrating the principles of the present invention. In FIG. 1, the rear of the cabinet is indicated by the wooden member 16, and cabinet face frame is indicated at 20 and 22 at the right in FIG. 1.

The roller 32 is mounted on the lower rear corner of the drawer 14. The roller 32 is confined within and engages the track 34 which is mounted on one side of the drawer 14 betwen the drawer and the adjacent supporting frame of the cabinet. The drawer 14 is provided with a small roller 36 which is mounted under the front edge of the lefthand side of the drawer, which has a bottom 34.

Figure 2:
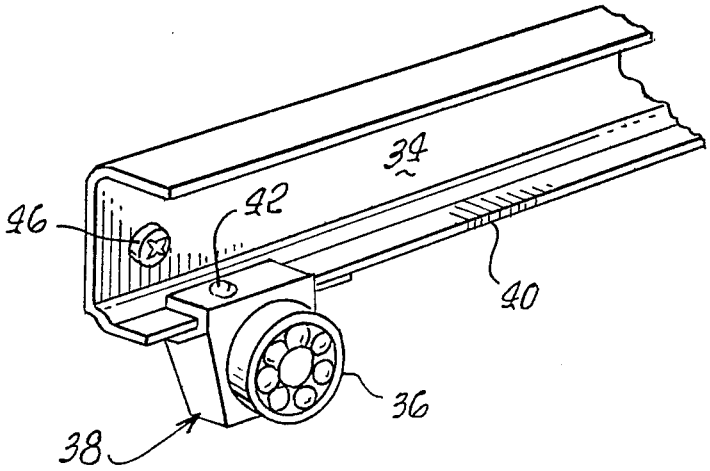
FIG. 2 is a perspective view of a track and a roller thereon, usable in the FIG. 1 section.
Figure 3:
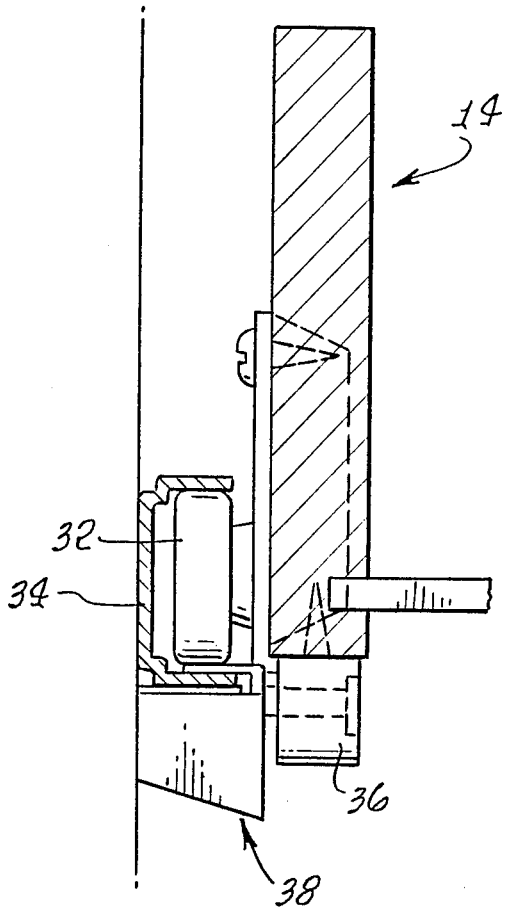
FIG. 3 is an enlarged section on lines 3—3 of FIG. 1.

The arrangements for mounting the roller 36 are shown to advantage in FIG. 2. More specifically, a bracket 38 fits snugly over the lower flange 40 of the rail 34, and is secured thereto by a suitable fastener 42 or by mechanically indenting both the bracket 38 and the rail 40 so that they remain in the interlocked position shown in FIG. 2.

The rail or track 34 shown in FIG. 1 is held in position as by screws such as the screw 46 as shown in FIG. 2. See also FIG. 4.

In accordance with the invention, track level adjustment mechanism is provided for adjusting the level of an elongated drawer track relative to cabinetry support structure. The track may be carried on the cabinet support structure, in which case the track does not move; or the track may be carried on support structure which is part of the drawer, but still referred to as "cabinetry support structure", or "support structure." Generally the invention is characterized by an assembly including:

(a) said track having a wall portion facing the support structure, (b) a dog element adjacent said wall portion and a fastener attaching that element to the support structure to be loosened for allowing movement of the dog element relative to the support structure and to the track wall portion, (c) and shoulder means on the track to be engaged by the dog element in response to said dog element movement relative to the support structure, thereby to level adjust said track wall portion relative to the support structure.

In FIGS. 4, 5 and 6, elongated metal track 126, corresponding for example to track 34, is channel shaped, and has a wall portion or web 126*a* facing the support structure 125 (which may be wooden, and may be part of the movable drawer, or of the fixed cabinet structure). The track also includes upper and lower flanges 126b and 126c. A dog element, in the form of a rotor 127 has a flat surface 127a extendinga adjacent the track wall portion 126a. A fastener, such as screw 122 attaches the rotor to the support structure 125, and is shown as having a head 122a at the outer side of the rotor, and a shank 122b passing through an opening 130 in the rotor, through an opening 131 in wall portion 126a, and then into the support structure. That screw is loosenable to allow movement of the dog element (rotation of the rotor about the fastener axis in the FIGS. 4–6 for example) relative to the support structure and to the track wall portion. Since the fastener 122 is located eccentrically relative to the rotor, the rotor is eccentrically rotatable. A screw driver tip 187 may be inserted in a notch 188 in the rotor periphery to rotate it. A cylindrical stub axle 189 on the rotor rotates loosely in circular opening 131, due to tolerance looseness.

Shoulder means on the track engageable by the dog element comprises (in the example) the under shoulder 131' of opening 131. Therefore, when rotor 127 is pivoted to raise uppermost periphery 189' of stub axle 189, the track is elevated at that location, pivoting about a fastener locus at 46 remote from the rotor 127. This tilts, or level adjusts, the track 126 relative to the support structure 125. The track may be lowered in the same way.

Note that, in FIG. 4, as rotor is pivoted up about the axis of screw 122, it pivots counterclockwise, whereas track 125 is pivoted clockwise (about screw 46). Such pivoting continuous until lock up due to tolerance take up. The same lock up occurs on downward pivoting of 127 and 125, providing a range of adjustment position of the elements, and also providing assured support for the track. When exact adjustment is achieved, the fastener 122 is tightened to clamp the rotor against the track wall portion 126a, which is, in turn, clamped against the support structure 125. A staple 121, or other means, is then driven through the plastic rotor and through opening 131 into the support structure, to positively locate the rotor in adjusted position, preventing downward displacement of the track relative to the support structure, under drawer imposed loading.

Note in FIG. 5 that roller 124 is spaced from the head 122a of the fastener; also, the rotor 127 extends or projects into opening 131.

FIGS. 9–11 show another form of rotor 227 eccentrically rotatable about the axis of fastener 222, to lift flange 226b of track 226. Fastener 222 is close to the periphery of the rotor; and the rotor has a portion 226d that projects into the opening defined by wall portion 226a of track 226.

FIGS. 12–14 show yet another dog element, in the form of a clamp 327 having a stem 327d that projects into vertical opening 331 defined by wall portion 326a of track 326. Stem 327d guides betwen vertical edges 331a and 331b of the opening 331, allowing up or down adjustment of the track, when the fastener 322 is loosened. When the fastener is then tightened on the clamp, the clamp holds the track in position. A screw may be used to attach through the hole 324 in the adjusted track, holding it in position. See also wooden support 325.

FIGS. 16–17 show a dog element in the form of a gear segment 427 having teeth 427a that mesh with teeth 429a of a rack 429. The latter is attached to wall portion 426a of a track 426, whereas the gear segment pivots on a fastener 422 attached to the wooden support 425 against which the track is to be held. See also FIGS. 7 and 8 showing similar structure. Rack 429 may be part of the rail.

These described "fine" adjustments may be made upon one or both of the tracks that support the drawer, so that precison support of the slidable drawer is achieved.

I claim:

1. Track level adjustment mechanism for adjusting the level of an elongated drawer track relative to cabinetry track support structure, comprising:

(a) said track having a wall portion facing the support structure, (b) a dog element adjacent said wall portion and a fastener attaching that element to the support structure to be loosened for allowing movement of the dog element relative to the support structure and to the track wall portion, (c) and shoulder means on the track to be engaged by the dog element in response to said dog element movement relative to the support structure, thereby to level adjust said track wall portion relative to the support structure.

2. The mechanism of claim 1 wherein the said wall portion defines a through opening and the dog element extends in said opening toward the support structure.

3. The mechanism of claim 2 wherein said dog element is an elongated rotor.

4. The mechanism of claim 1 wherein the track defines a channel in which said dog element is received, and including drawer supporting roller means in the channel.

5. The mechanism of claim 4 wherein the track is supported at a locus at a distance from the dog element so that the track is tilted about said locus in response to said movement of the dog element to displace said shoulder means.

6. The mechanism of claim 1 wherein said dog element is a rotor.

7. The mechanism of claim 6 wherein the track is supported at a locus at a distance from the dog element so that the track is tilted about said locus in response to said movement of the dog element to displace said shoulder means, and wherein the dog element pivots counterclockwise as the track pivots clockwise as the track is tilted about said locus, the dog element and the shoulder means on the track interferring to limit said pivoting.

8. The mechanism of claim 1 wherein the dog element is a rotary gear section.

9. The mechanism of claim 1 wherein said dog element is a clamp overlying said wall portion.

10. The mechanism of claim 9 wherein said fastener extends from said clamp through an opening defined by said track wall portion and into said support structure.

11. The mechanism of claim 10 including a fastener pivotally mounting the rotor and also extending through said opening to adjustably attach to said support structure.

12. The mechanism of claim 1 wherein the fastener pivotally mounts the dog element, and also extends through an opening defined by said wall portion to attach to said support structure.

13. Track level adjustment mechanism for adjusting the level of an elongated drawer track relative to cabinetry track support structure, comprising:

(a) said track having a wall portion facing the support structure, the wall portion having an opening therethrough, (b) a rotor pivotally mounted adjacent said wall portion to overlie said opening and to be rotatable relative to the support structure and to the track wall portion, (c) and shoulder means on the track to be displaced in response to rotation of the rotor, thereby to level adjust said track wall portion relative to the support structure.

* * * * *